US008087496B1

(12) United States Patent
Taylor

(10) Patent No.: US 8,087,496 B1
(45) Date of Patent: Jan. 3, 2012

(54) RAMP SYSTEM

(76) Inventor: Daniel E. Taylor, Parsons, TN (US)

( * ) Notice: Subject to any disclaimer, the term of this patent is extended or adjusted under 35 U.S.C. 154(b) by 254 days.

(21) Appl. No.: 12/396,501

(22) Filed: Mar. 3, 2009

(51) Int. Cl.
*B66B 9/06* (2006.01)

(52) U.S. Cl. ..... 187/245; 414/921

(58) Field of Classification Search ..... 414/921; 187/245
See application file for complete search history.

(56) References Cited

U.S. PATENT DOCUMENTS

| | | | | | |
|---|---|---|---|---|---|
| 1,321,780 | A | * | 11/1919 | Anderson | 187/244 |
| 1,768,650 | A | * | 7/1930 | Wood | 187/201 |
| 1,838,204 | A | * | 12/1931 | Wood | 187/201 |
| 3,014,556 | A | | 12/1961 | Stelzer | |
| 3,341,874 | A | | 9/1967 | Jarvis | |
| 3,592,294 | A | * | 7/1971 | Allen | 187/241 |
| 3,661,228 | A | | 5/1972 | Glasser | |
| 4,026,387 | A | | 5/1977 | Abreu | |
| 4,026,388 | A | * | 5/1977 | Creissels | 187/245 |
| 4,046,226 | A | * | 9/1977 | Flinchbaugh | 187/202 |
| 4,179,012 | A | * | 12/1979 | Heberle | 187/201 |
| 4,345,669 | A | | 8/1982 | Noall | |
| 4,401,178 | A | | 8/1983 | Studer | |
| 4,438,830 | A | * | 3/1984 | Born | 187/201 |
| 4,690,065 | A | * | 9/1987 | Belanger et al. | 104/172.3 |
| 5,050,708 | A | | 9/1991 | Wood | |
| 5,553,548 | A | | 9/1996 | Eaton | |
| 6,109,854 | A | * | 8/2000 | Thompson et al. | 414/398 |
| 6,739,430 | B2 | * | 5/2004 | Hill | 187/245 |
| 6,957,716 | B1 | | 10/2005 | Norris | |
| 7,103,935 | B2 | * | 9/2006 | Hill | 14/71.3 |
| 2006/0104772 | A1 | | 5/2006 | Miller et al. | |

* cited by examiner

*Primary Examiner* — Charles A Fox
(74) *Attorney, Agent, or Firm* — Neustel Law Offices

(57) ABSTRACT

A ramp system for efficiently transferring a wheelchair or other vehicle from one vertical end of the ramp to the other. The ramp system generally includes a ramp including a slot, wherein the slot extends through the ramp along a longitudinal length of the ramp between an upper end and a lower end of the ramp, a drive assembly mounted proximate the ramp and a catch tool connected to the drive assembly, wherein the catch tool travels between the upper end and the lower end of the ramp via the drive assembly, wherein the catch tool travels within the slot of the ramp.

16 Claims, 10 Drawing Sheets

RAMP SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to wheelchair ramps and more specifically it relates to a ramp system for efficiently transferring a wheelchair or other vehicle from one vertical end of the ramp to the other.

2. Description of the Related Art

Any discussion of the related art throughout the specification should in no way be considered as an admission that such related art is widely known or forms part of common general knowledge in the field.

Wheelchair ramps have been in use for years. Typically a wheelchair ramp consists of a sloped ramp angling at a slight incline in order to allow the individual in the wheelchair to easily push their way up the ramp, descend the ramp, or to drive up the ramp. Extensive side rails are also generally needed so that the individual in the wheelchair may grab onto something while ascending or descending the ramp.

Many nuisances and problems exist with current wheelchair ramps. One such nuisance is that in order for the wheelchair ramp to be easily ascended or descended, the ramp must generally be very long with respect to the height that must be climbed. This often times requires the ramp to crisscross or wind back and forth, and thus may take up a lot of space, be expensive to construct and cause a lengthy climb or descend for the wheelchaired individual. Another problem with the use of wheelchair ramps is that the individual in the wheelchair is often times relying upon another person to assist them in ascending or descending the ramp. This can substantially decrease the independency of the individual in the wheelchair.

Yet another problem with existing wheelchair ramps is that because of their required length and size, the ramps are often permanent structures thus not allowing for portability and causing the individual in the wheelchair to have restricted access to many buildings or elevated walkways that do not include a wheelchair ramp. Because of the inherent problems with the related art, there is a need for a new and improved ramp system for efficiently transferring a wheelchair or other vehicle from one vertical end of the ramp to the other.

BRIEF SUMMARY OF THE INVENTION

The general purpose of the present invention is to provide a ramp system that has many of the advantages of the wheelchair ramps mentioned heretofore. The invention generally relates to a wheelchair ramp which includes a ramp including a slot, wherein the slot extends through the ramp along a longitudinal length of the ramp between an upper end and a lower end of the ramp, a drive assembly mounted proximate the ramp and a catch tool connected to the drive assembly, wherein the catch tool travels between the upper end and the lower end of the ramp via the drive assembly, wherein the catch tool travels within the slot of the ramp.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a ramp system for efficiently transferring a wheelchair or other vehicle from one vertical end of the ramp to the other.

Another object is to provide a ramp system that is portable.

An additional object is to provide a ramp system that uses a powered mechanism to transfer the wheelchair from one vertical end of the ramp to the other.

A further object is to provide a ramp system that is adaptable to many different kinds of wheelchairs.

Another object is to provide a ramp system that is easy to operate.

Another object is to provide a ramp system that may be used to assist the ascent or descent of various other objects or wheeled vehicles upon the ramp other than wheelchairs.

Another object is to provide a ramp system that can be used by a wheelchair occupant to ascend or descend the stairs without assistance from any other person.

Another object is to provide a ramp system that includes a cable which can be power operated and controlled by a remote control in the hands of the wheelchair occupant.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
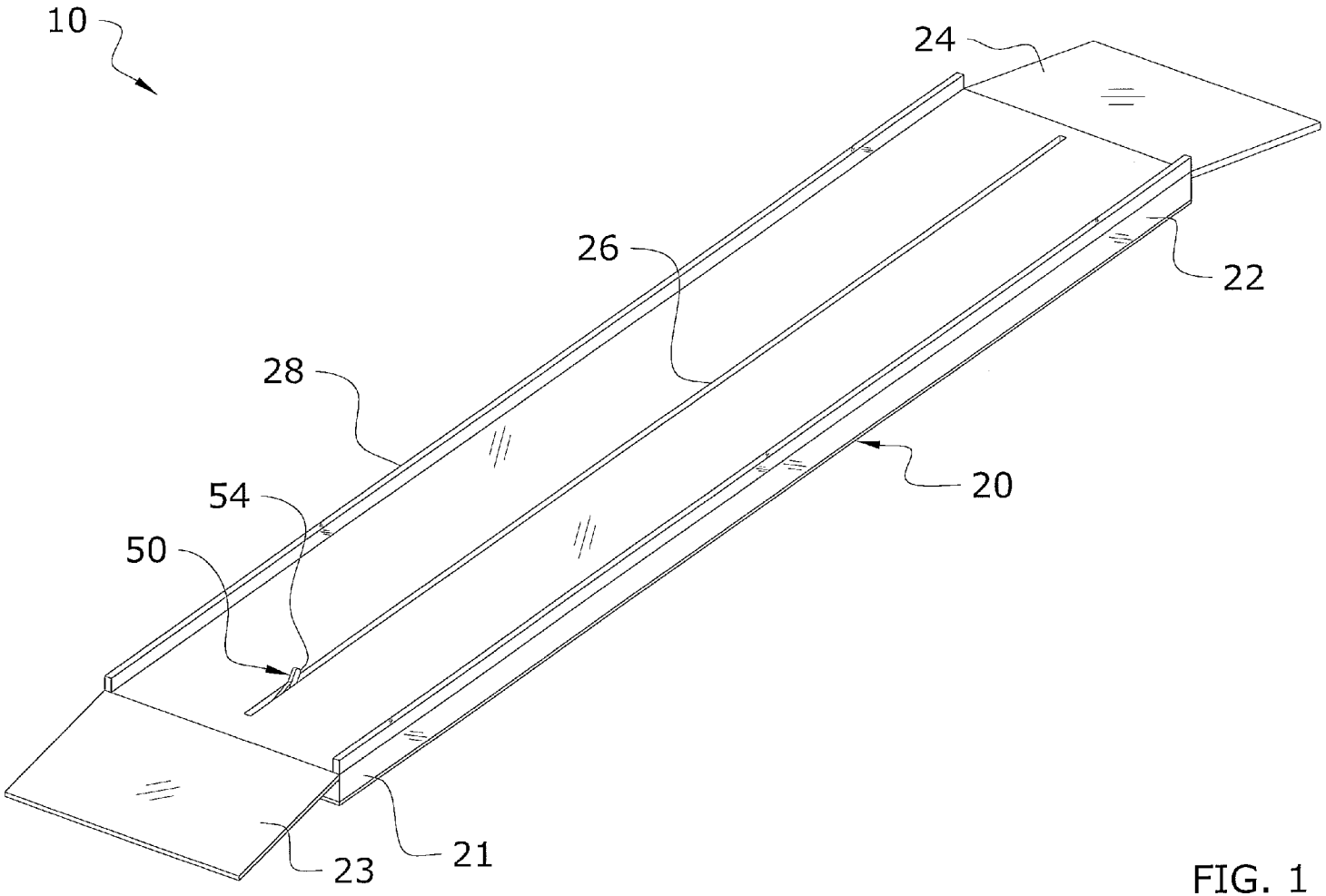
FIG. 1 is an upper perspective view of the present invention.
Figure 2:
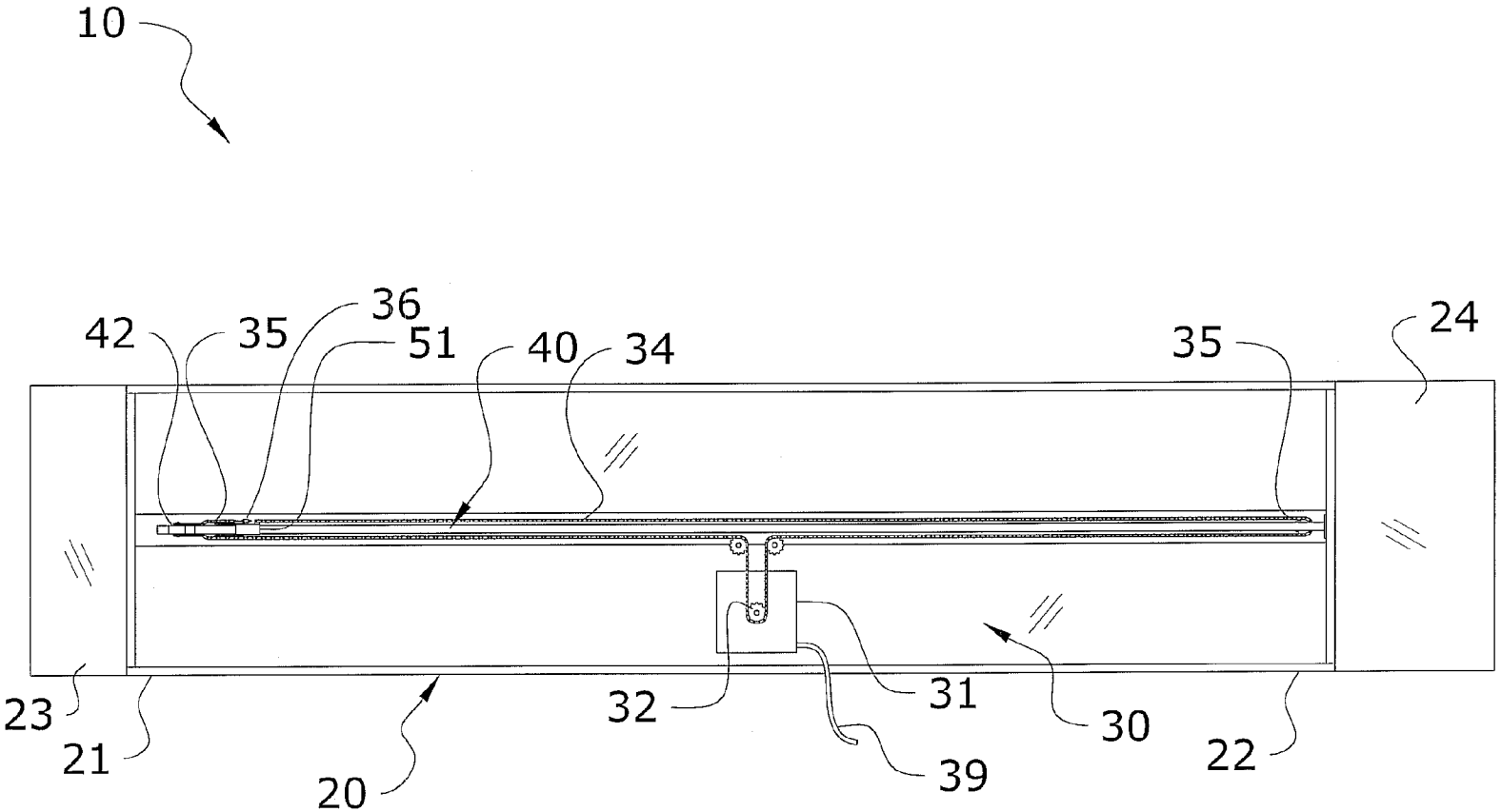
FIG. 2 is a bottom view of the present invention.
Figure 3:
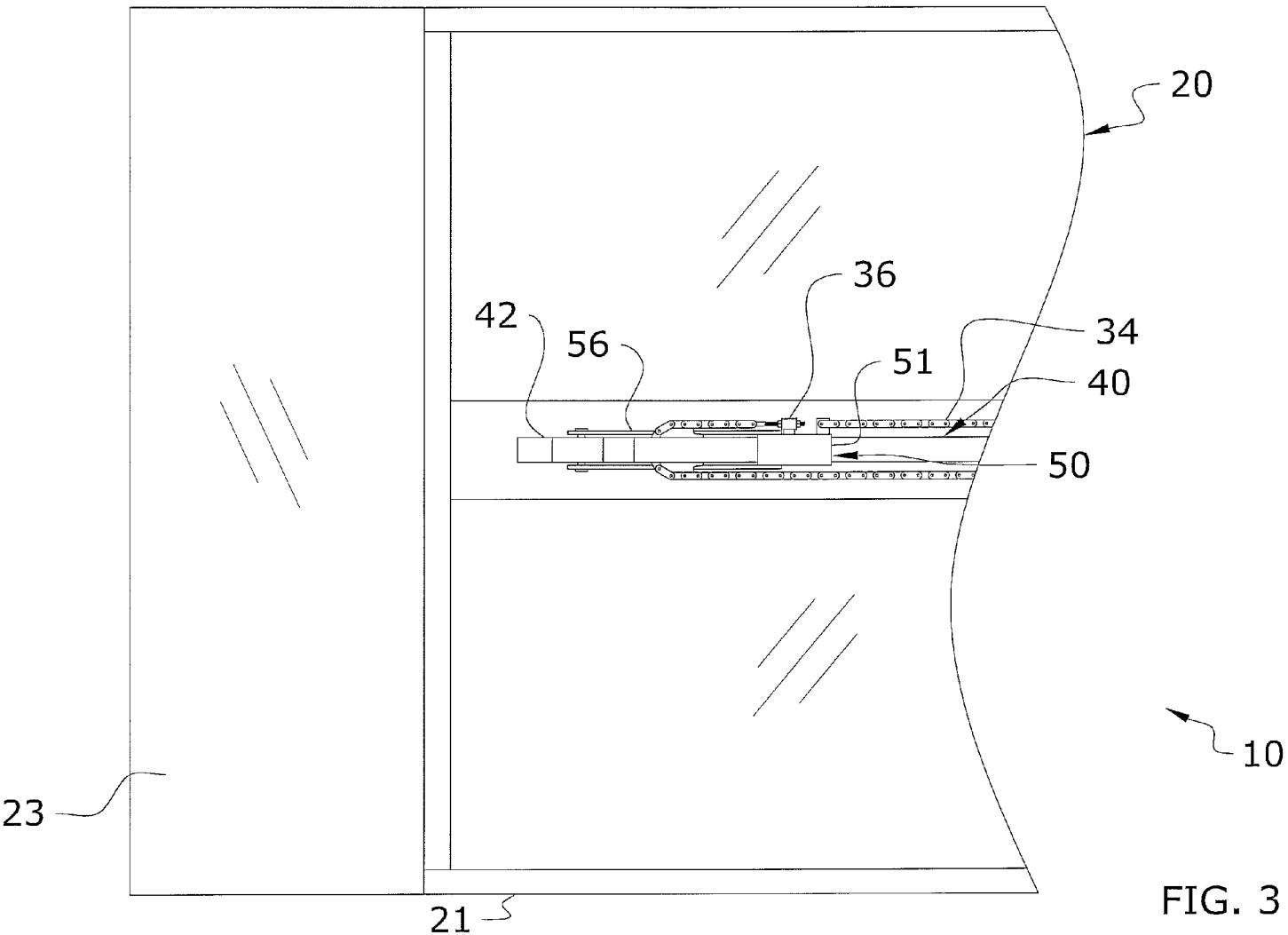
FIG. 3 is a cutaway bottom view of the present invention illustrating the catch tool.
Figure 4:
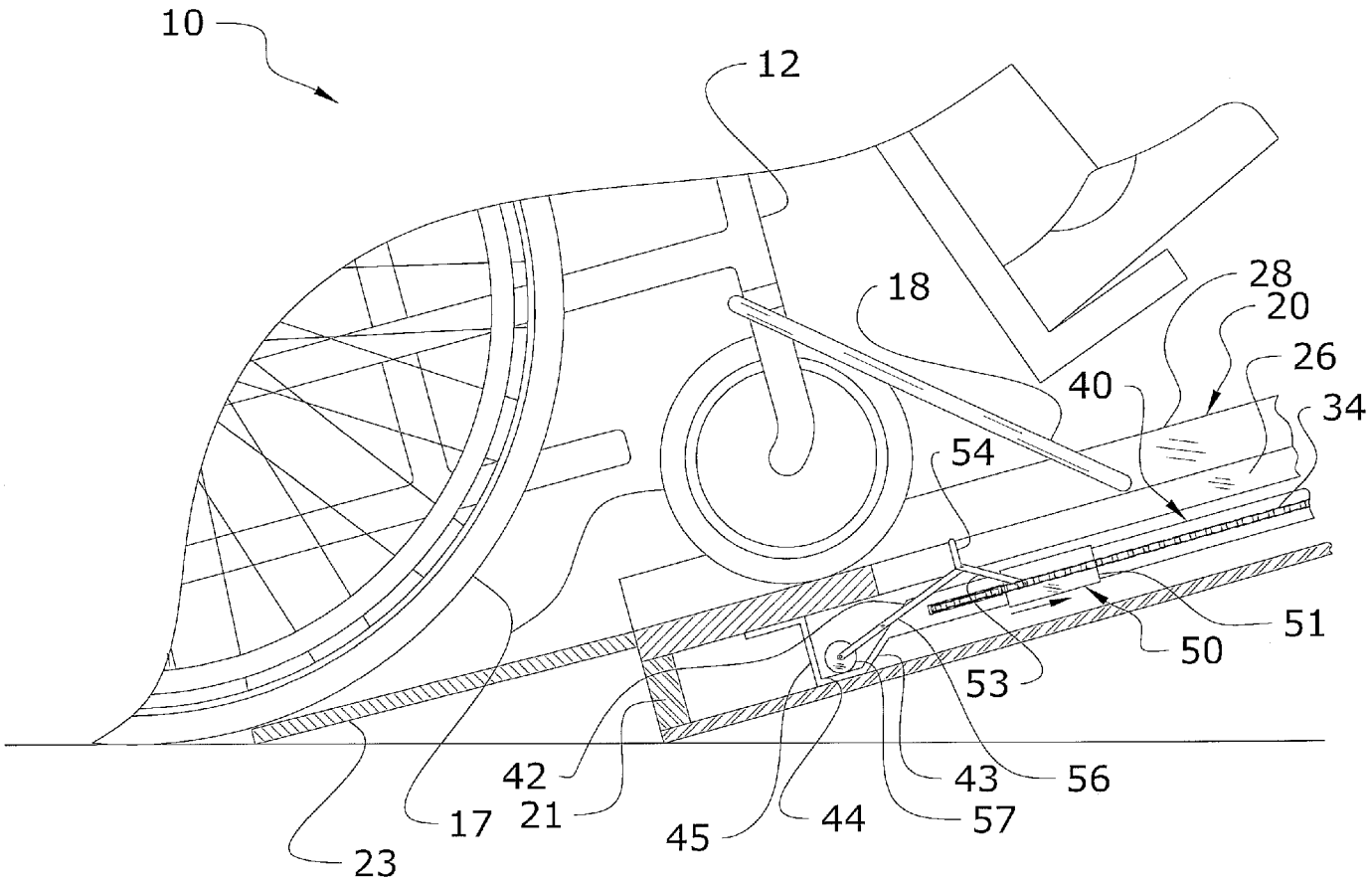
FIG. 4 is a sectional side view illustrating the catch tool in a lowered position so that the catch portion is level with or below the top side of the ramp.
Figure 5:
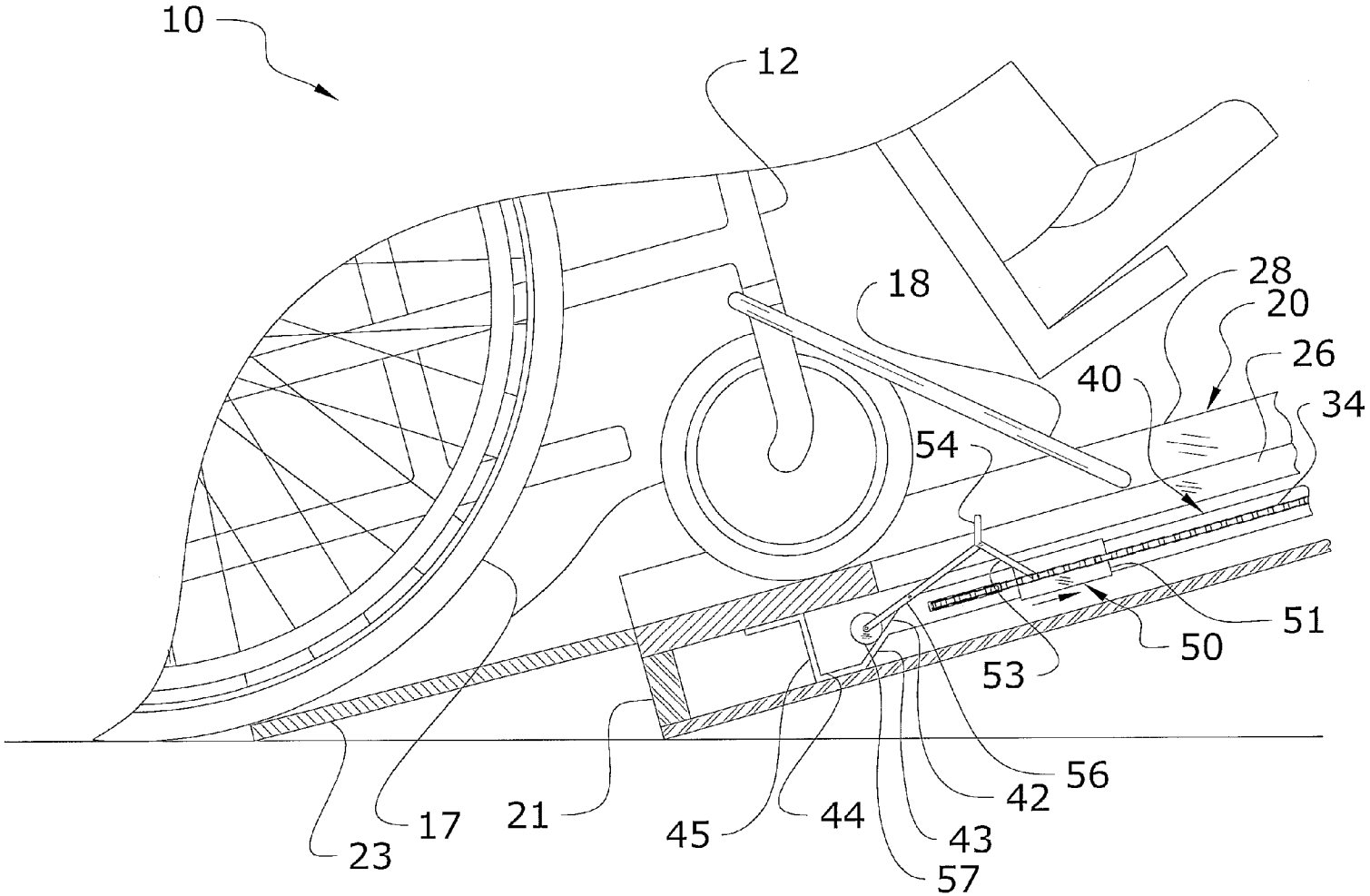
FIG. 5 is a sectional side view illustrating the catch tool in an intermediary position so that the catch portion is slightly above the top side of the ramp.
Figure 6:
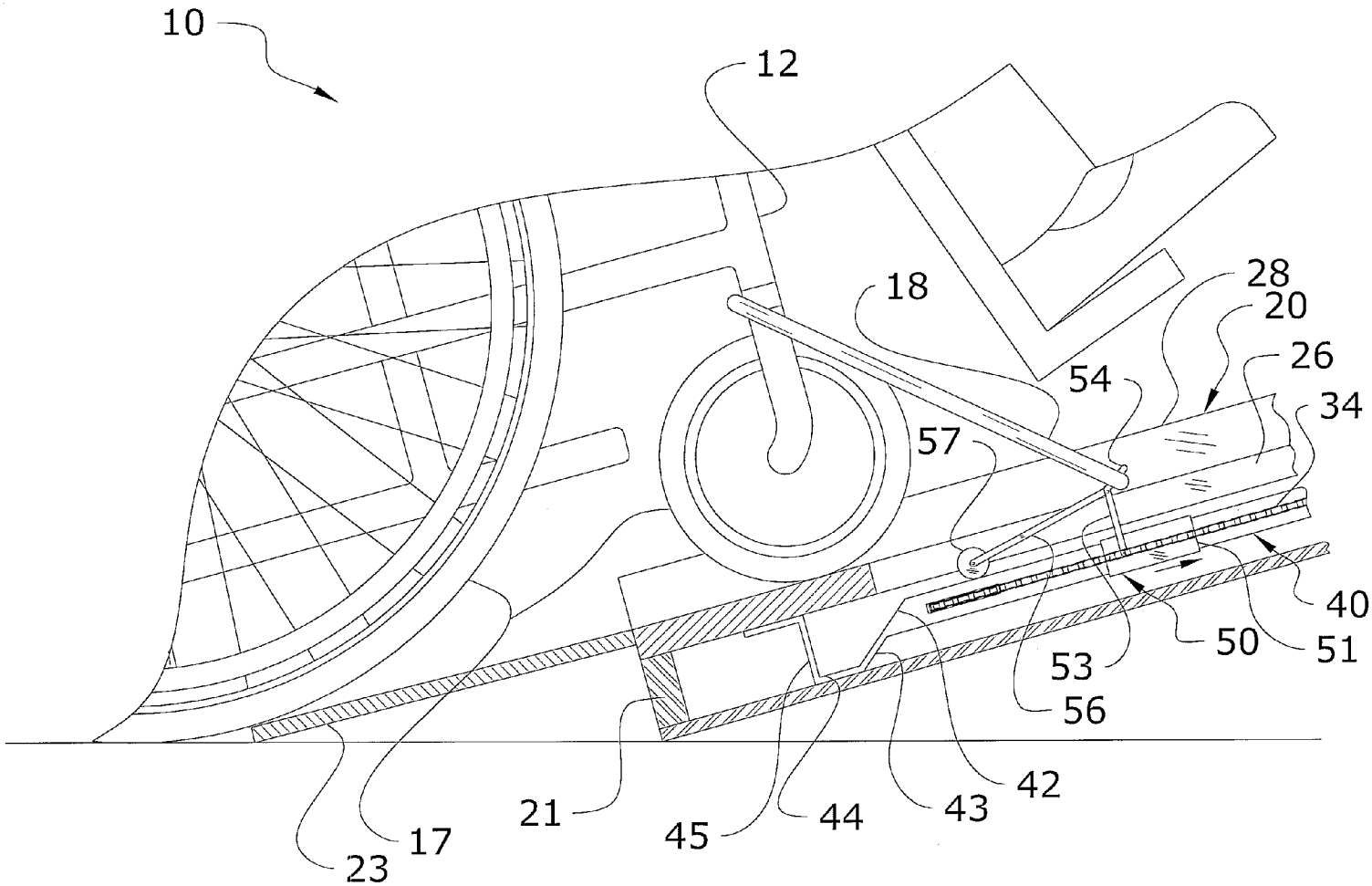
FIG. 6 is a sectional side view illustrating the catch tool in an in use position so that the catch portion is above the top side of the ramp so as to grab the catch element.
Figure 7:
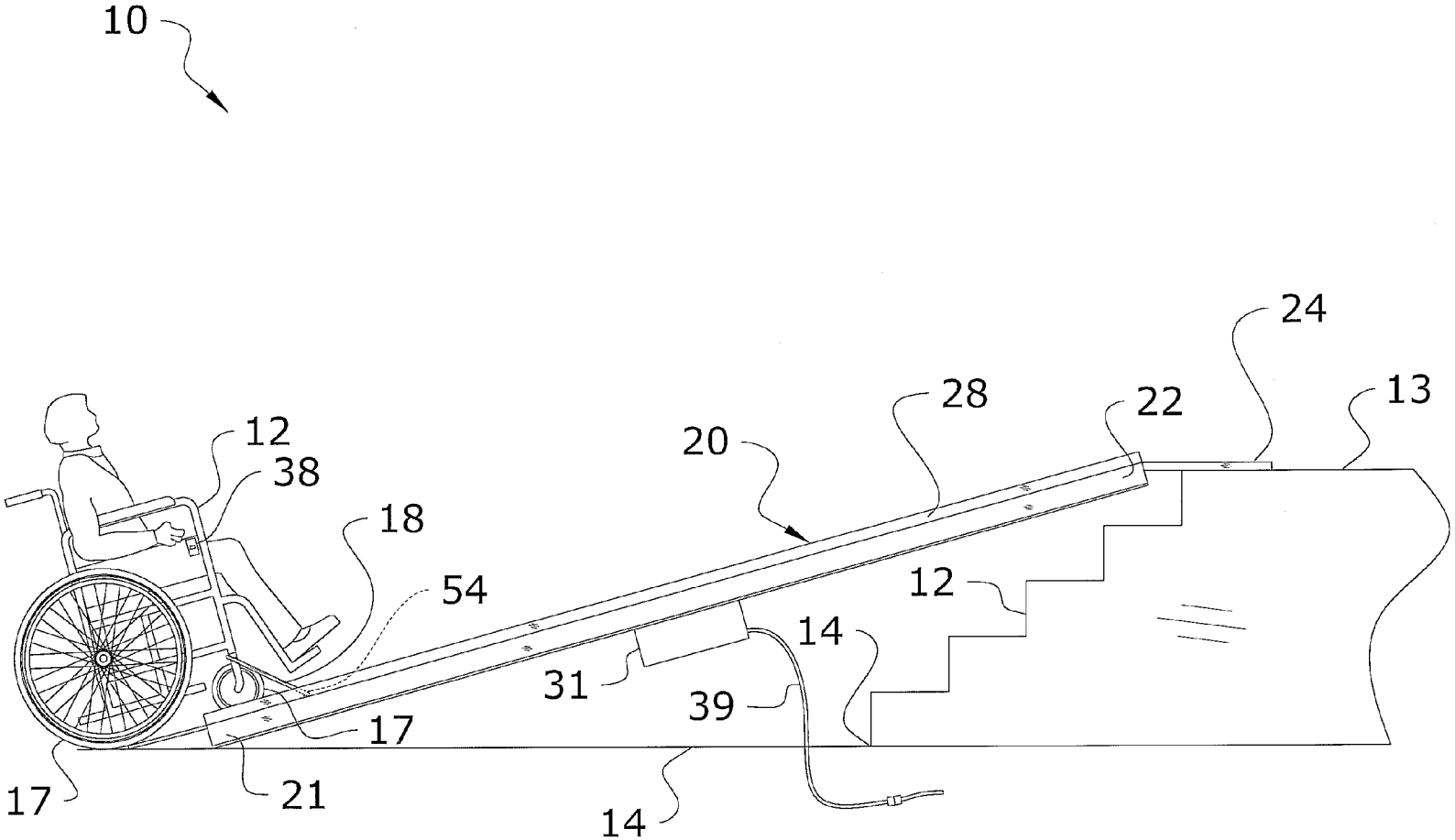
FIG. 7 is a side view of the present invention with a wheelchair and operator positioned at a lower end of the ramp.
Figure 8:
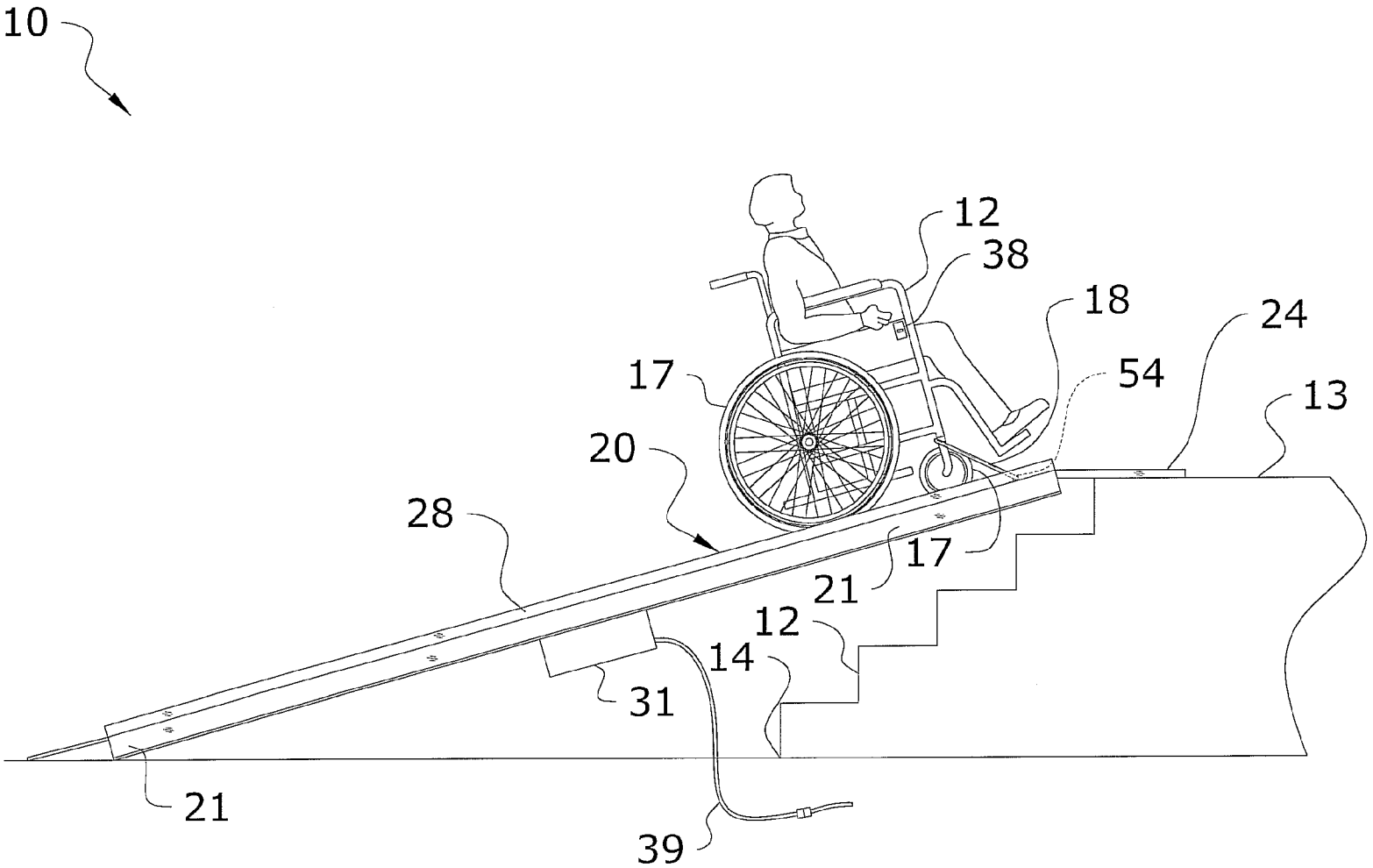
FIG. 8 is a side view of the present invention with a wheelchair and operator transferred to an upper end of the ramp.
Figure 9:
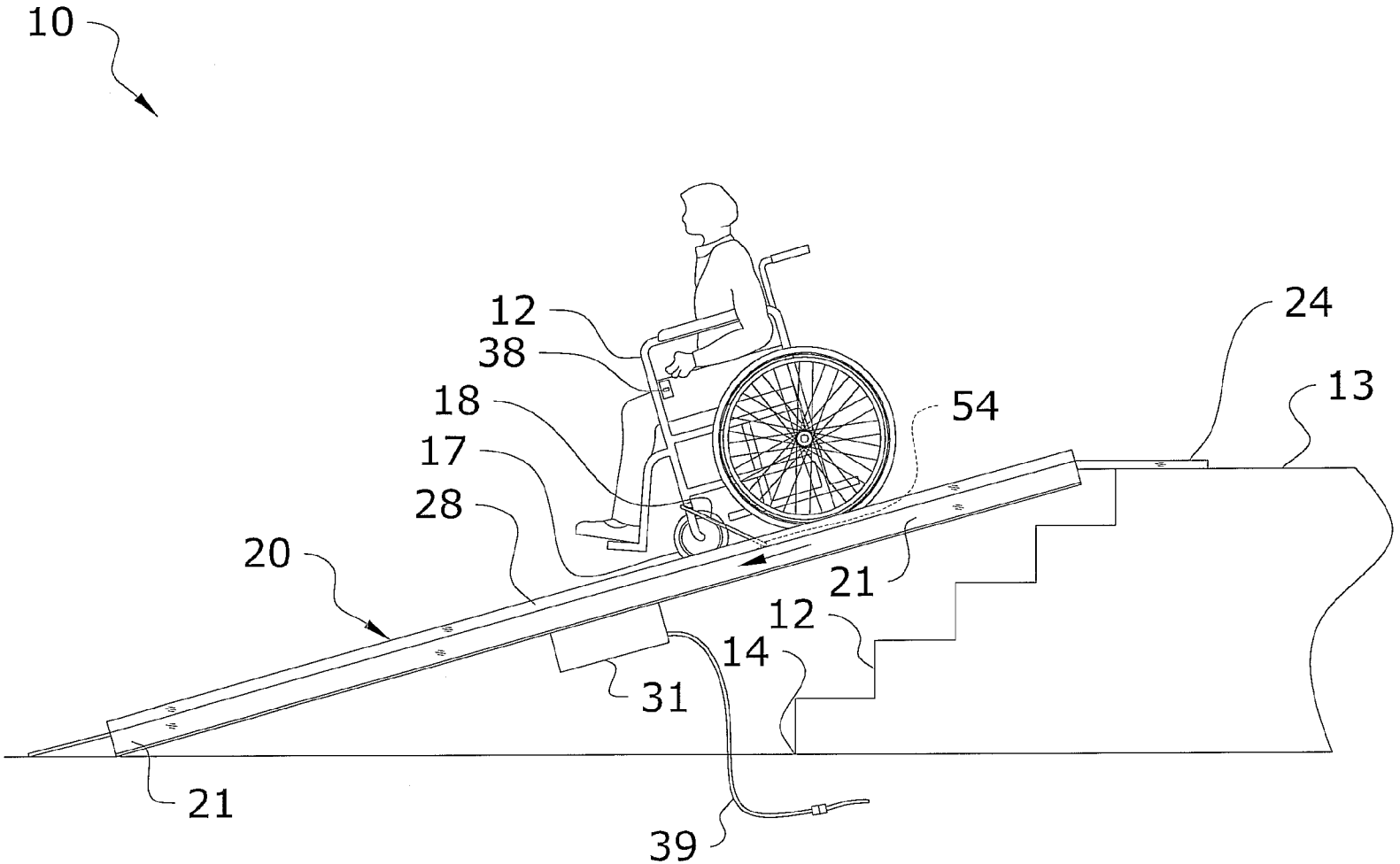
FIG. 9 is a side view of the present invention with a wheelchair and operator descending down the ramp.
Figure 10:
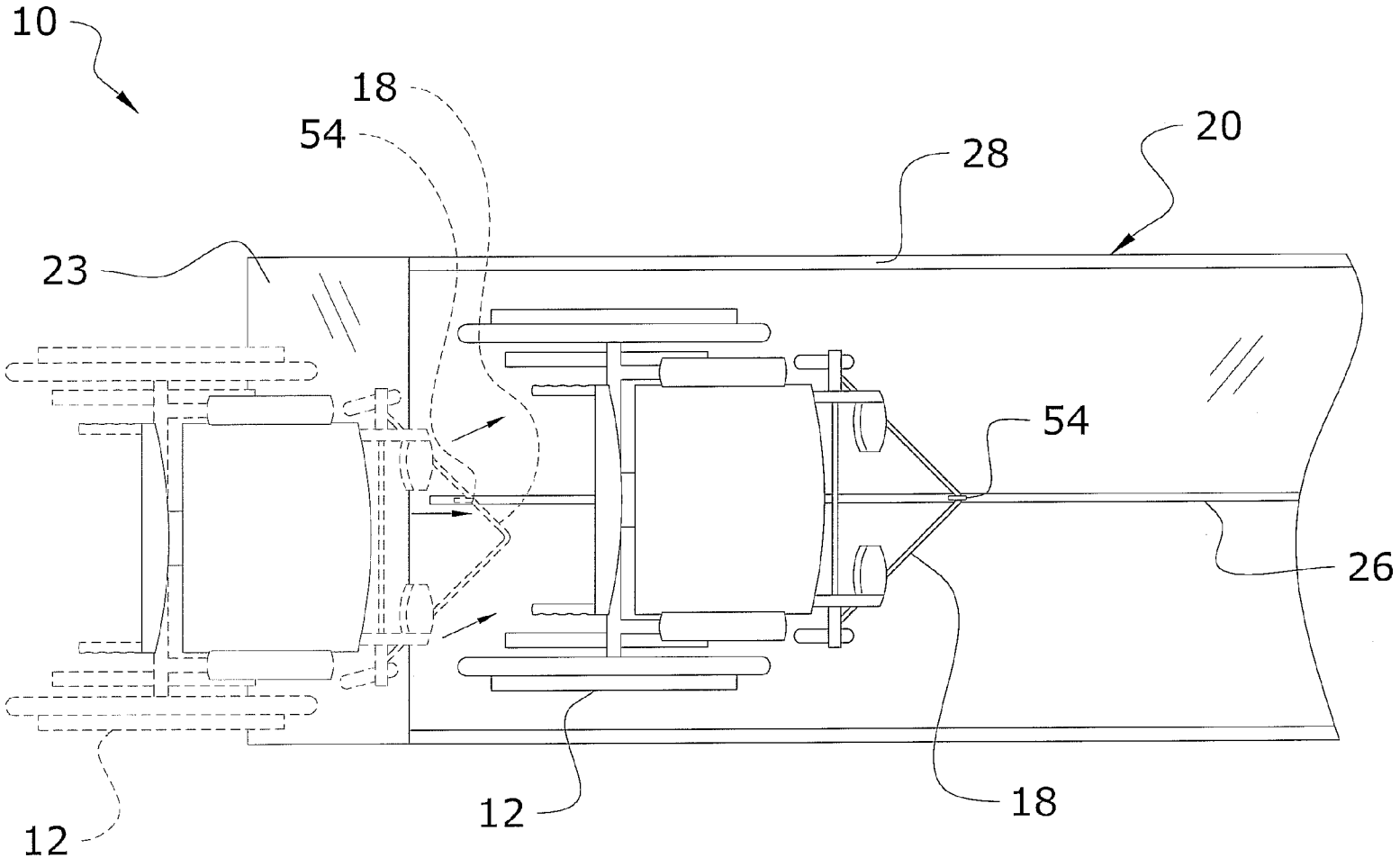
FIG. 10 is a top view illustrating the wheelchair being centered upon the ramp via the catch element.

Turning now descriptively to the drawings, in which similar reference characters denote similar elements throughout the several views, FIGS. 1 through 10 illustrate a ramp system 10, which comprises a ramp 20 including a slot 26, wherein the slot 26 extends through the ramp 20 along a longitudinal length of the ramp 20 between an upper end and a lower end of the ramp 20, a drive assembly 30 mounted proximate the ramp 20 and a catch tool 50 connected to the drive assembly 30, wherein the catch tool 50 travels between the upper end and the lower end of the ramp 20 via the drive assembly 30, wherein the catch tool 50 travels within the slot 26 of the ramp 20.

It is appreciated that the present invention may be used to transfer various objects or vehicles from one end of the ramp 20 to the other rather than solely wheelchairs 16. The present invention may further be used in connection with or not in connection with a flight of stairs 12, wherein the present invention may simply be used as a powered ramp 20 for moving objects into a trailer or vehicle.

B. Ramp

The ramp 20 is of a sufficient length to extend over a flight of stairs 12 and be securely positioned or attached at a height substantially even with both an upper level 13 of the stairs 12 and a lower level 14 of the stairs 12. It is appreciated that the ramp 20 may be removed from the stairs 12 when desired so as to be comprised of a portable structure. It is also appreciated that the ramp 20 may be affixed to the stairs 12 if desired.

The ramp 20 is also comprised of a sufficient width in order to accommodate a wheelchair 16. The ramp 20 may include guides or other structures for the wheels 17 of the wheelchairs 16. The ramp 20 may also be comprised of simply a planar surface, wherein no need for traction is generally needed since the catch tool 50 guides the wheelchair 16 up or down the ramp 20.

The ramp 20 includes an upper portion 22 that is secured adjacent to an upper level 13 or top stair 12 of the flight of stairs 12. The upper portion 22 is configured so that the wheelchair 16 operator experiences a smooth transition from the ramp 20 to the top platform of the stairs 12 or reversely. An upper bracket 24, such as an L-upper bracket 24, also preferably extends from the upper portion 22 to rest upon the upper level 13 of the stairs 12 or connect thereto.

The lower portion 21 likewise is positioned near the ground surface so that the wheelchair 16 operator experiences a smooth transition from the ground surface to the ramp 20 or reversely. A lower bracket 23 may also be used to ensure a smooth transition. In the preferred embodiment, the lower bracket 23 is comprised of a steeper angle than the rest of the ramp 20; however it is appreciated that the angle of the lower bracket 23 may be parallel with the angle of the rest of the ramp 20.

The ramp 20 also includes an elongated slot 26 extending substantially along the entire length of the ramp 20 to receive the catch tool 50 which connects to the wheelchair 16. The elongated slot 26 is of a configuration that allows the catch tool 50 to efficiently slide within. The ramp 20 may further include side guides to ensure that the wheelchair 16 does not fall off of the ramp 20.

C. Drive Assembly

A drive assembly 30 is connected to or mounted proximate the ramp 20 to drive the catch tool 50 from the bottom of the ramp 20 to the top of the ramp 20 or reversely and thus provide a means to transfer the wheelchair 16 up or down the ramp 20. The drive assembly 30 may be comprised of various configurations all which move the catch tool 50 from one end of the ramp 20 to the other.

In the preferred embodiment, the drive assembly 30 includes a motor 31 which is generally positioned underneath the ramp 20 and in the preferred embodiment positioned at the longitudinal center of the bottom of the ramp 20. In the preferred embodiment, the motor 31 is comprised of an electric motor 31, wherein a power cord 39 extends from the motor 31 that is to be plugged in to an electrical socket prior to use. It is appreciated, however, that other types of fuel to power the motor 31 may be appreciated.

The motor 31 may further be controlled in various manners and is preferably controllable by the wheelchair 16 operator while using the ramp 20. To do this, a remote controller 57 38 is desired. The remote controller 57 38 has functions to operate the motor 31 in a forward or reverse manner to be used when ascending or descending the ramp 20. It is appreciated that multiple speeds or other functions may also be appreciated.

The motor 31 drives at least one drive sprocket 32 that is used to drive the chain 34 about the ramp 20, wherein the trolley 51 and catch tool 50 are fixed to the chain 34. The chain 34 circulates via the drive sprocket 32 and is positioned in a manner parallel to the ramp 20. A pair of rotatable end sprockets 35 are also positioned on each end of the underside of the ramp 20 for the chain 34 to circulate around. A chain tightener 36 may also extend from one end of the chain 34.

D. Guide Track

A guide track 40 is positioned underneath the ramp 20 to guide the catch tool 50 along the ramp 20 and at a parallel angle with the ramp 20. The guide track 40 follows the chain 34 and preferably includes at least one elongated flat surface to follow the ramp 20, wherein a roller 57 of the catch tool 50 travels along the guide track 40 from one end of the ramp 20 to the other when using the present invention. The guide track 40 must thus extend from one end of the track to the other and preferably extends from end to end at a consistent distance away from ramp 20 that the catch tool 50 maintains its position relative to the height of the ramp 20 while moving from one end to the other. The guide track 40 may include various guide elements to ensure that the roller 57 remains on a fixed path; however it is appreciated that the roller 57 will generally stay upon the guide track 40 as the roller 57 is fixed to the catch tool 50 which is fixed to the chain 34.

The guide track 40 is further preferably comprised of a square tubing configuration to receive the trolley 51 of the catch tool 50, wherein the trolley 51 is also comprised of a square tubing configuration and travels along the guide track 40 from one end to the other. Bearings, such as plastic inserts, may be positioned between the outside of the guide track 40 and the trolley 51 to prevent the trolley 51 from binding as the trolley 51 travels along the guide track 40.

An end piece 42 extends from the guide track 40 at the lowermost end of the guide track 40 and ramp 20. The end piece 42 extends below the guide track 40 at a distance further away from the ramp 20 than the rest of the guide track 40. The end piece 42 serves to lower the catch tool 50 and move the catch tool 50 back through the slot 26 towards the underside of the ramp 20 so as to allow the catch tool 50 to release from the wheelchair 16. It is appreciated that the end piece 42 is generally only needed at the lower end of the guide track 40 because the catch tool 50 grabs the wheelchair 16 from a rear of a catch element 18 of the wheelchair 16 and thus the wheelchair 16 is simply able to move forwardly away from the catch tool 50 at the upper end of the ramp 20.

The catch element 18 is comprised of a V-shaped configuration to center the wheelchair 16 by moving the catch portion 54 toward the tip of the catch element 18. The catch element 18 is further able to pivot or adjust so as to extend either forward with respect to the wheelchair 16 when ascending the ramp 20 or rearward with respect to the wheelchair 16 when descending the ramp 20. The catch element 18 may further be comprised of a triangular configuration, wherein the base rod (perpendicular to the ramp) rotates or swings when adjusting to accommodate a ascending or descending movement of the wheelchair 16 along the ramp 20.

The end piece 42 generally includes an angled portion 43 that angles downwardly and away from the guide track 40 so as to gradually lower the catch tool 50 via the roller 57 moving along the angled portion 43. A flat (or parallel to the ramp 20) resting portion 44 extends outwardly from the angled portion 43 to finally receive the roller 57 of the catch tool 50, which is where the catch tool 50 sits until the ramp 20 is to be used again. The resting portion 44 of the end piece 42 is a sufficient distance away from the top side of the ramp 20 so that the catch tool 50 is below the top side of the ramp 20 and thus not able to catch upon the wheelchair 16. The end piece 42 may also include a stop portion 45 to ensure that the roller 57 does not go back too far and fall off of the end piece 42.

It is appreciated that the end piece 42 may be separately formed or integrally formed with the guide track 40. Thus a first portion of the top surface of the guide track 40 is a first distance from the top side of said ramp 20 and a second portion of the top surface of the guide track 40 (i.e. resting portion 44) is a second distance from the top side of the ramp 20, wherein the first distance is closer to the top side than said second distance. The roller 57 travels along the first portion and the second portion of the guide track 40 to move the catch tool 50 into a first position or a second position, wherein the catch tool 50 in the first position extends substantially above a top side of the ramp 20 and wherein the catch tool 50 in the second position is substantially level with the top side of the ramp 20.

E. Catch Tool

The catch tool 50 is moved along the ramp 20 via the drive assembly 30 and is used to catch upon the catch element 18 of the wheelchair 16 and move the wheelchair 16 from one vertical end of the ramp 20 to the other. The catch tool 50 includes a trolley 51 that is fixed to the chain 34. The trolley 51 is preferably comprised of a square tubing configuration to be guided along the guide track 40. As mentioned previously, bearings or plastic inserts may be used to prevent the trolley 51 from binding while moving along the guide track 40. As the chain 34 circulates via the motor 31, the catch tool 50 and attached trolley 51 are moved along the ramp 20.

Extending vertically from the trolley 51 is first shank 53. The first shank 53 preferably extends in a perpendicular manner from the trolley 51 at distance equal that spans from the trolley 51 to the top side of the ramp 20. The first shank 53 is also preferably pivotally attached to the trolley 51 to allow the catch tool 50 to pivot beneath the top side of the ramp 20 when the trolley 51 is at the lower end of the guide track 40.

A catch portion 54 extends from the top end of the first shank 53. The catch portion 54 preferably is able to extend beyond the top side of the ramp 20 so as to allow the catch element 18 of the wheel chair to be secured upon the catch portion 54 of the tool. The catch portion 54 further preferably extends at a forward angle from the first shank 53.

A second shank 56 extends rearwardly from the first shank 53 at a downward angle. The second shank 56 connects the roller 57 to the tool, wherein the roller 57 follows or leads (depending on the direction of travel) the trolley 51. The roller 57 is meant to set the height of the catch portion 54 relative to the ramp 20. When the roller 57 is positioned within the rest portion of the end piece 42 and thus the trolley 51 is at the lower end of the ramp 20, the first shank 53 pivots downwards thus bringing the catch portion 54 below or substantially level with the top side of the ramp 20. As the trolley 51 moves forwardly toward the upper portion 22 of the ramp 20, the roller 57 travels up the angled portion 43 of the end piece 42 and onto the guide track 40 thus pivoting the first shank 53 and catch portion 54 upwardly so as to rise above the top side of the ramp 20.

F. Operation of Preferred Embodiment

In use, at the lower end of the ramp 20, the wheels 17 of the wheelchair 16 are aligned with the ramp 20 and the catch element 18 of the wheelchair 16 is positioned slightly forward of the catch tool 50 (wherein the catch tool 50 is below or substantially level with the top side of the ramp 20 at this time). The catch element 18 of the wheelchair 16 may be a modification or preexisting component. The catch element 18 is preferably a cable or elongated piece that includes a loop or hook on which to connect to the catch tool 50.

The wheelchair 16 operator then starts the motor 31 with the remote controller 57 38 which drives the chain 34 and subsequently moves the trolley 51. As the trolley 51 moves forward, the roller 57 moves up the angled portion 43 of the end piece 42 and onto the guide track 40, thus pivoting the catch portion 54 upward above the top side of the ramp 20 so as to catch upon the catch element 18 of the wheelchair 16. The trolley 51 continues to move forward with the chain 34 along the guide track 40 all the way to the upper end of the ramp 20 while pulling the wheelchair 16 and operator behind.

At the upper end of the ramp 20, the wheelchair 16 operator is able to move or push the wheelchair 16 off of the ramp 20 and onto the top platform of the flight of stairs 12. The motor 31 is also stopped at this time, thus leaving the catch tool 50 at the upper end of the ramp 20.

When desiring to descend the ramp 20, the wheelchair 16 operator pulls forward facing down the ramp so that the wheelchair 16 is guided onto the ramp 20 being careful to guide the catch element 18 onto the catch portion 54 of the catch tool 50. It is appreciated that alternatively the wheelchair 16 may be backed in a reverse manner down the ramp 20. Once the catch element 18 is secured onto the catch tool 50, the motor 31 is started in a reverse manner and the trolley 51 and catch tool 50 are moved toward a lower end of the ramp 20 thus suspendedly holding the wheelchair 16 and operator.

At the lower end of the ramp 20, the roller 57 moves into the resting portion 44 of the end piece 42, thus pivoting the catch member downward so as to release the catch element 18 of the wheelchair 16. The wheelchair 16 operator may now move away from the ramp 20 as desired.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A portable ramp system for moving a wheelchair, comprising:

a portable ramp having a first end, a second end, a top surface, and a bottom surface, and a slot, wherein said slot extends from said first end to said second end;

a chain and sprocket drive assembly mounted to said ramp;

a guide track supported below said bottom surface of said ramp and along said slot; and a catch tool having a trolley, a first shank, and a catch portion, wherein said trolley is connected to said guide track such as to be movable along a length of said guide track and wherein said trolley is connected to a chain of said chain and sprocket assembly, wherein said first shank extends from said trolley such as to be aligned with said slot and wherein said catch portion angularly extends from said first shank through said slot such as to extend above said top surface of said ramp;

wherein said catch portion angles towards said second end such as to permit a connected and a disconnected state of a catch element of a wheelchair with said catch portion, such that the catch element is retained around said catch portion as said catch tool moves along said guide track via said chain and sprocket drive assembly from said first end to said second end of said ramp and from said second end to said first end of said ramp.

2. The portable ramp system of claim 1, wherein said catch tool includes a second shank and a roller, wherein said second shank angularly extends from said first shank and wherein said roller is rotatably connected to a terminal end of said second shank such that said roller follows said trolley when said catch tool travels from said first end to said second end, wherein said roller is in contact with said guide track.

3. The portable ramp system of claim 2, wherein said first shank is pivotally connected to said trolley such that a first vertical position of said roller adjusts a second vertical position of said catch portion relative said trolley, said guide track and said chain and sprocket drive assembly.

4. The portable ramp system of claim 3, wherein said guide track includes a first portion, a second portion, and a third portion, wherein said first portion is parallel with said top surface of said ramp, wherein said second portion is parallel with said top surface of said ramp, wherein said first portion is offset from said second portion, and wherein said third portion is angularly positioned and connects said first portion to said second portion, wherein said roller travels along said first portion, said second portion, and said third portion to adjust said second vertical position of said catch portion.

5. The portable ramp system of claim 4, wherein said roller makes contact with and travels along a top of said first portion, said second portion, and said third portion of said guide track.

6. The portable ramp system of claim 5, wherein said guide track includes a backstop portion extending from said first portion opposite said second portion to restrict movement of said roller.

7. The portable ramp and wheelchair system of claim 1, wherein said chain and sprocket drive assembly includes a motor.

8. The portable ramp and wheelchair system of claim 7, including a remote controller to operate said motor.

9. A ramp and wheelchair system, comprising:

a ramp having a first end, a second end, a top surface, and a bottom surface, and a slot, wherein said slot extends from said first end to said second end;

a chain and sprocket drive assembly mounted proximate said ramp;

a guide track supported below said bottom surface of said ramp and along said slot;

a catch tool having a trolley, a first shank, and a catch portion, wherein said trolley is connected to said guide track such as to be movable along a length of said guide track and wherein said trolley is connected to a chain of said chain and sprocket assembly, wherein said first shank extends from said trolley such as to be aligned with said slot and wherein said catch portion angularly extends from said first shank through said slot such as to extend above said top surface of said ramp and wherein said catch portion angles towards said second end; and a wheelchair having a catch element, wherein said catch element is comprised of a V-shape and wherein said catch element extends forwardly from said wheelchair;

wherein said catch element is adapted to connect and disconnect around said catch portion of said catch tool as said catch tool moves along said guide track via said chain and sprocket drive assembly from said first end to said second end of said ramp and from said second end to said first end of said ramp such as to move said wheelchair along said ramp between said first end and said second end.

10. The ramp and wheelchair system of claim 9, wherein said catch tool includes a second shank and a roller, wherein said second shank angularly extends from said first shank and wherein said roller is rotatably connected to a terminal end of said second shank such that said roller follows said trolley when said catch tool travels from said first end to said second end, wherein said roller is in contact with said guide track.

11. The ramp and wheelchair system of claim 10, wherein said first shank is pivotally connected to said trolley such that a first vertical position of said roller adjusts a second vertical position of said catch portion.

12. The ramp and wheelchair system of claim 11, wherein said guide track includes a first portion, a second portion, and a third portion, wherein said first portion is parallel with said top surface of said ramp, wherein said second portion is parallel with said top surface of said ramp, wherein said first portion is offset from said second portion, and wherein said third portion is angularly positioned and connects said first portion to said second portion, wherein said roller travels along said first portion, said second portion, and said third portion to adjust said second vertical position of said catch portion such that said catch portion is adjusted above at least a portion of said catch element of said wheelchair when said roller is upon said first portion of said guide track such as to retain said catch element thereon and pull said catch element and such that said catch portion is adjusted completely below said catch element of said wheelchair when said roller is upon said second portion such as to release said catch element therefrom.

13. The ramp and wheelchair system of claim 12, wherein said roller makes contact with and travels along a top of said first portion, said second portion, and said third portion of said guide track.

14. The ramp and wheelchair system of claim 13, wherein said guide track includes a backstop portion extending from said first portion opposite said second portion to restrict movement of said roller.

15. The ramp and wheelchair system of claim 9, wherein said chain and sprocket drive assembly includes a motor.

16. The ramp and wheelchair system of claim 15, including a remote controller to operate said motor.

* * * * *